US006641286B2

(12) United States Patent
Hincher, Sr.

(10) Patent No.: US 6,641,286 B2
(45) Date of Patent: Nov. 4, 2003

(54) FIRE EXTINGUISHER MOUNT/LOCATOR

(76) Inventor: William M. Hincher, Sr., 23 Pittenger Pond Rd., Freehold, NJ (US) 07728

( * ) Notice: Subject to any disclaimer, the term of this patent is extended or adjusted under 35 U.S.C. 154(b) by 0 days.

(21) Appl. No.: 09/961,257

(22) Filed: Sep. 25, 2001

(65) Prior Publication Data

US 2003/0058645 A1 Mar. 27, 2003

(51) Int. Cl.[7] ..... F21V 33/00

(52) U.S. Cl. ..... 362/253; 362/276; 169/88; 169/51; 340/693.5; 340/693.2

(58) Field of Search ..... 362/253, 276; 169/88, 51; 340/693.5, 693.2, 691.1, 693.9, 310.08, 331

(56) References Cited

U.S. PATENT DOCUMENTS

| | | | | |
|---|---|---|---|---|
| 4,015,250 A | | 3/1977 | Fudge | |
| D244,392 S | | 5/1977 | Montambo | |
| D266,061 S | | 9/1982 | Wenzlaff | |
| 4,360,802 A | | 11/1982 | Pinto | |
| 4,548,274 A | | 10/1985 | Simpson | |
| 4,787,460 A | | 11/1988 | Clarkson | |
| 4,916,438 A | | 4/1990 | Collins et al. | |
| 5,153,567 A | * | 10/1992 | Chimento | 340/691.5 |
| 5,408,771 A | | 4/1995 | Manrubia | |
| 5,412,887 A | | 5/1995 | Layne | |
| 5,446,439 A | | 8/1995 | Kramer et al. | |
| 5,586,048 A | * | 12/1996 | Coveley | 702/189 |
| 5,952,919 A | * | 9/1999 | Merrill | 340/539 |
| 6,124,796 A | | 9/2000 | Hincher | |

* cited by examiner

*Primary Examiner*—Sandra O'Shea
*Assistant Examiner*—Bertand Zeade
(74) *Attorney, Agent, or Firm*—Siemens Patent Services, LC

(57) ABSTRACT

There is provided an illuminated mounting system for storing a small, domestic type fire extinguisher in a manner allowing quick location and retrieval in the event of a fire. A rear section of a housing is plugged into a convenient electrical outlet and a fire extinguisher is mounted thereon. In a first embodiment, a front section of the housing, containing an illuminating beacon/nightlight and a rechargeable flashlight, hinges closed to secure the fire extinguisher in place. The mount/locator may be used as a flashlight either with or without the fire extinguisher in place. In a second embodiment, the illuminating beacon/nightlight and a rechargeable flashlight plug into a receptacle in the rear housing allowing use of the flashlight without disturbing the fire extinguisher. The second embodiment may also have one or more supplementary outlets which replace or supplement the receptacle into which the mount/locator is plugged.

16 Claims, 3 Drawing Sheets

FIRE EXTINGUISHER MOUNT/LOCATOR

REFERENCE TO RELATED APPLICATION

This application is related to Ser. No. 08/824,353 filed on Mar. 25, 1997, now issued as U.S. Pat. No. 6,124,796, on Sep. 26, 2000.

BACKGROUND OF THE INVENTION

1. Field of the Invention

The present invention relates to improvements in fire extinguisher locator systems. More particularly, the invention comprises a portable fire extinguisher locator system, for domestic type fire extinguishers, having a beacon/nightlight light, flashlight and auxiliary electrical receptacles incorporated into the design.

2. Description of the Prior Art

In the home it is often difficult to keep a domestic type fire extinguisher, as are marketed by Kidde®, First Alert®, and others, in a location where it would be readily available when needed. Fire extinguishers are not typically an item that is aesthetically pleasing in home decor, therefore there is an inclination to not keep them out in the open where they could be easily located in an emergency. When they are left out in the open, or even stored in a cabinet, they are often hidden by other items, making them hard to locate when they are needed. A variety of solutions have been presented throughout the years, including:

U.S. Pat. No. 4,787,460, issued to Joseph G. Clarkson on Nov. 29, 1988, presents a covering or mounting plate which is brightly marked in distinctive patterns for a fire extinguisher mounted in a building for making the fire extinguisher conspicuous. However, under conditions where ambient illumination is weak or absent, even the bright and distinctive markings of Clarkson's cover are susceptible to being rendered inconspicuous. By contrast, the present invention provides a self-illuminated mounting, thereby overcoming inadequate ambient light.

U.S. Design Pat. No. 244,392, issued to Roger J. Montambo on May 17, 1977, presents a bracket for mounting a fire extinguisher which is representative of brackets available, but none of which provides any means of illumination.

U.S. Design Pat. No. 266,061, issued to Karl H. Wenzlaff on Sep. 7, 1982 presents a bracket having an associated light. However, unlike the present invention, Wenzlaff's bracket is intended to support the light, but not the fire extinguisher.

U.S. Pat. Nos. 5,408,771, issued to Bob Manrubia on Apr. 25, 1995, and 5,412,887, issued to James R. Layne on May 9, 1995, present, respectively, an illuminated box frame and an illuminated cabinet. In both cases, the subject mount nearly completely encloses the extinguisher. By contrast, the present invention has only limited enclosure of the extinguisher, making removal a simple procedure.

U.S. Pat. No. 5,153,567, issued to Samuel V. Chimento on Oct. 6, 1992, presents an alarm kit having a mounting plate for an extinguisher with audible and visual alarm systems. The illumination of Chimento, however, is in response to removal of the extinguisher and does not serve as a beacon for locating the extinguisher.

U.S. Pat. No. 4,015,250, issued to William L. Fudge on Mar. 29, 1977, also presents a fire extinguisher cabinet having an alarm activated by the removal of the extinguisher. In contrast, in the present invention the beacon serves as a locator means rather than as an alarm.

U.S. Pat. No. 6,124,796, issued to the applicant on Sep. 26, 2000, presents an illuminated extinguisher bracket which is permanently installed at a location. The present invention, on the other hand, is a plug-in unit which may be moved from place to place, and additionally provides auxiliary receptacles, a nightlight and/or a removable flashlight which may be used either in conjunction with the extinguisher or separately.

None of the above inventions and patents, taken either singly or in combination, is seen to describe the instant invention as claimed.

SUMMARY OF THE INVENTION

The present invention is an embodiment of a fire extinguisher locator system for domestic or other light duty fire extinguishers. In the home it is often difficult to keep a fire extinguisher in a location where it would be readily available should the need arise. Since they do not readily fit into a decorated environment, such as a home or office, extinguishers are often hidden away in a cabinet, hidden behind other objects or buried under the clutter of counter tops which could make readily locating the fire extinguisher difficult in an emergency. The present invention provides an illuminated mount for storing the extinguisher in a manner that it is out of the way, yet readily located in an emergency.

Accordingly, it is a principal object of the invention to provide a fire extinguisher mount/locator device which may be easily located in an emergency.

It is a further object of the invention to provide a fire extinguisher mount/locator device which is easy to install, use and maintain.

An additional object of the invention is to provide a fire extinguisher mount/locator incorporating a rechargeable battery.

Yet another object of the invention is to provide a fire extinguisher mount/locator device having a continuously lit, rechargeable battery powered, beacon/nightlight thereon to aid in locating the fire extinguisher in dark or dim conditions.

An additional object of the invention is to provide a fire extinguisher mount/locator that incorporates a rechargeable battery powered flashlight.

It is again an object of the invention to provide a fire extinguisher mount/locator that, in alternate embodiments, incorporates auxiliary electrical outlet(s) to replace the outlet(s) occupied by the mount/locator.

It is another object of the invention to provide a fire extinguisher mount/locator device which is aesthetically pleasing in a decorated environment, such as a home or office.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 3:
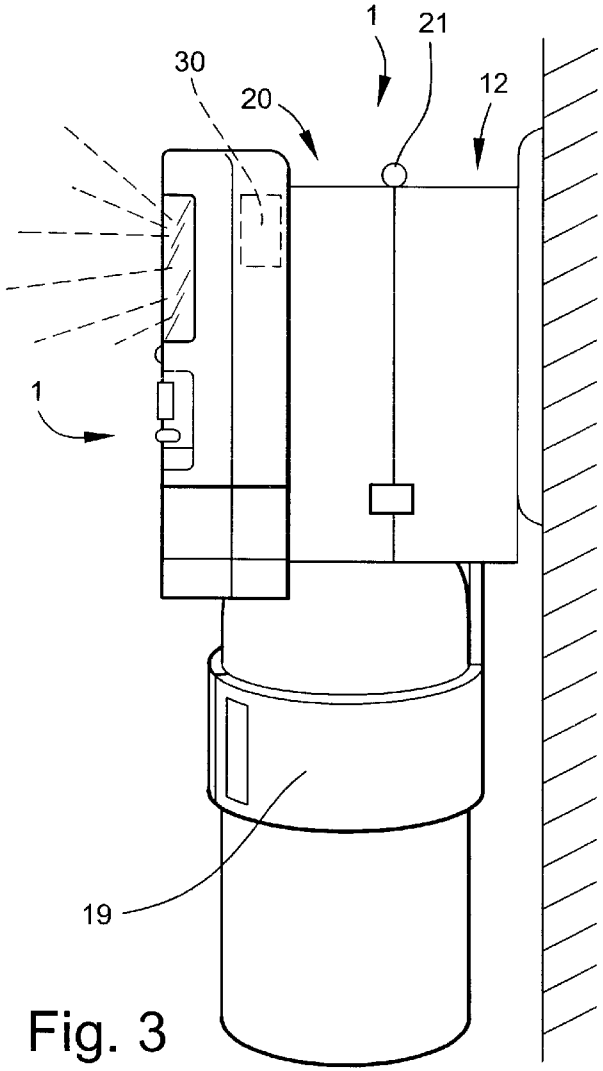
FIG. 3 is side view of an alternative embodiment of the the inventive fire extinguisher mount/locator with a fire extinguisher installed.
Figure 1:
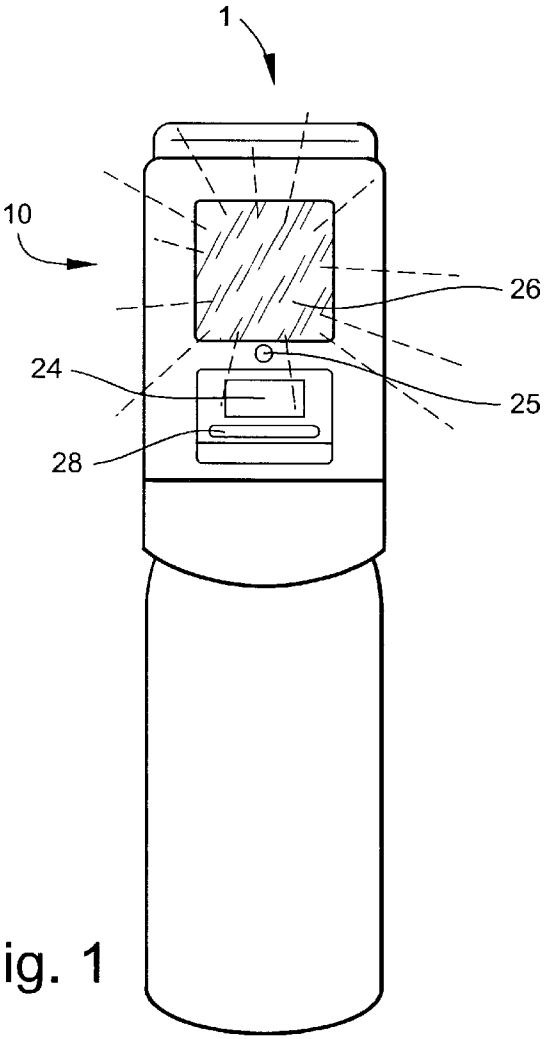
FIG. 1 is a front view of the inventive fire extinguisher mount/locator in a closed position with a fire extinguisher installed.
Figure 2:
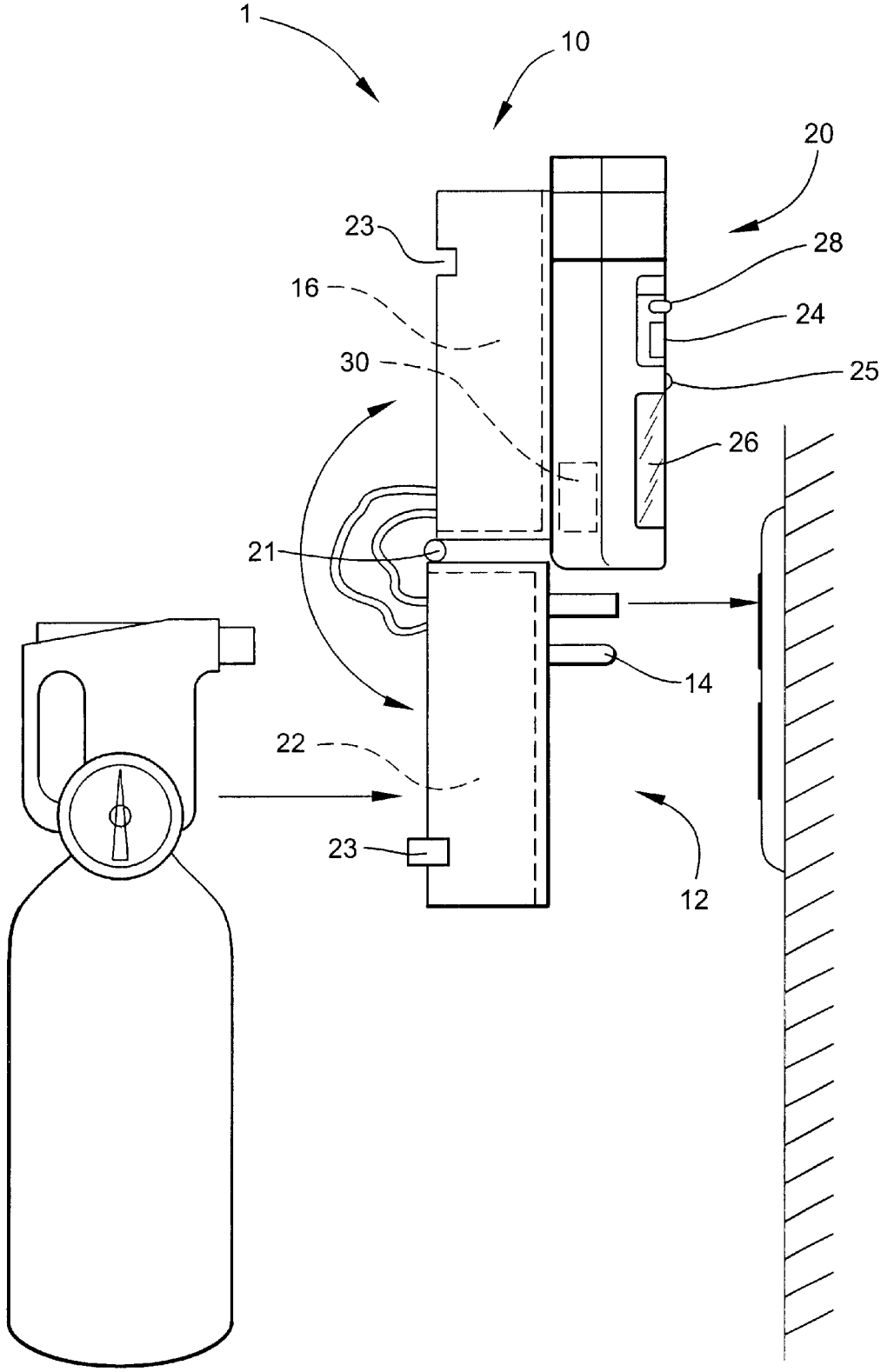
FIG. 2 is a side view of the inventive fire extinguisher mount/locator in an open position showing internal detail in phantom.

As illustrated in FIGS. 1 thru 3, extinguisher mount/locator 1 is a plug-in appliance for connection to ordinary household electrical outlets. The basic embodiment comprises body 10 manufactured of a material such as, but not limited to, a polymer, a metal or wood. Body 10 has a rear housing 12 which is substantially an open structure having a top, a back and two sides, the front and bottom being open, defining a concavity 16 within. An electrical plug 14 (preferably three pronged, although it would be evident to one skilled in the art that a two pronged plug may be acceptable in some applications) is mounted in the rear, exterior surface of rear housing 12. It would be evident to one skilled in the art that electrical plug 14 could be connected to rear housing 12 by a flexible electrical cord or that electrical plug 14 could be rotatable to accommodate either vertically or horizontally mounted wall receptacles. It would be further evident to one skilled in the art that concavity 16 could alternatively be formed within a substantially solid block of material as opposed to having thin, formed sides. Molded into the rear-most portion of the concavity 16 is a bracket 18 for receiving the neck of a fire extinguisher (shown, but not an integral part of the present invention). In an alternative embodiment, a retaining strap 19 of a material such as, but not limited to, Velcro® is used as a supplement to or replacement for bracket 18.

A front housing 20 of body 10 is, similarly, a substantially open structure having a concavity 22 in its rear surface. Front housing 20 and rear housing 12 are joined along their upper surface by a hinge 21 such that concavities 16, 22 surround the upper portion of the fire extinguisher, when installed. Front housing 20 and rear housing 12 are secured in a closed position by any well known method. In the embodiment chosen for purposes of disclosure, squeeze clips/notches 23 proximate the lower edge of the adjoining edges of front housing 20 and rear housing 12 have been chosen. An illuminated beacon/nightlight 24 is disposed in front housing 20 and electrically connected, by methods well known in the art, through rechargeable battery 30, of a type well known in the art, to electrical plug 14. It would be evident to one skilled in the art that an illumination and/or motion sensor 25 could be installed intermediate plug 14 and beacon/nighlight 24 to illuminate beacon/nightlight 24 only during periods of darkness or when approached by a moving body. Likewise, a switch could be installed intermediate plug 14 and beacon/nightlight 24 to dim or disable beacon/nightlight 24, when desired or a removable cover plate could be installed over beacon/nightlight 24 to dampen the illumination. A flashlight 26 is disposed in front housing 20, likewise being electrically connected, by methods well known in the art, to plug 14 through intermediate switch 28 and rechargeable battery 30 of a type well known in the art. Beacon/nightlight 24 aids in locating the extinguisher during periods of darkness while flashlight 26 is usable either in conjunction with the extinguisher or, when removed, independently from the extinguisher.

It would be evident to one skilled in the art that a supplemental electrical outlet (not shown), electrically connected, by means well known in the art, to plug 14, could be incorporated into either the rear housing 12 or front housing 20.

Figure 4:
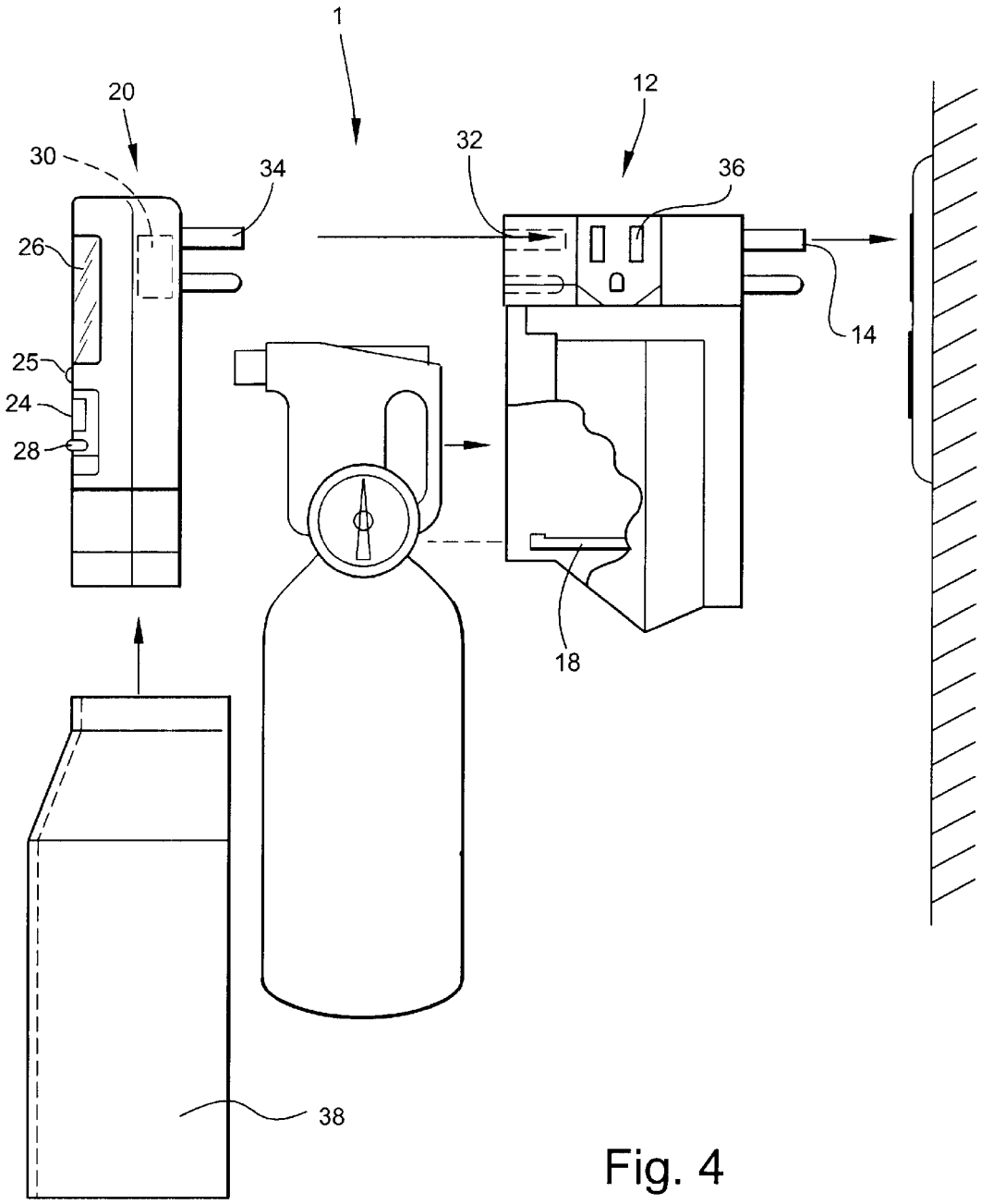
FIG. 4 is a side view of a second embodiment of the inventive fire extinguisher mount/locator, partially cut away, with its removable light module removed.

Referring now to FIG. 4 an alternate embodiment of the invention incorporates supplemental electrical outlets 36 which replace the wall outlet occupied by the the mount/locator 1. Rather than front housing 20 and rear housing 12 being hingedly attached, rear housing 12 contains an electrical receptacle 32 proximate its upper front surface and front housing 20 has an mating plug 34 whereby front housing 20 is attached to rear housing 12 and electricity is supplied to the beacon/nightlight 24 and flashlight 26, as well as supplemental outlet 36. It would be evident to one skilled in the art that mating plug 34 could be retractable into front housing 20 for more convenient use of front housing 20 as a flashlight.

In each embodiment presented hereinabove, an optional decorative plate 38 may be attached to the lower edge of body 10 to cover the fire extinguisher.

Each embodiment presented hereinabove could further incorporate a smoke detector with an audible alarm (not shown) as an additional protective measure, with the illumination of beacon/nightlight 24 being activated by the activation of the smoke detector.

It is to be understood that the present invention is not limited to the embodiments described above, but encompasses any and all embodiments within the scope of the following claims.

What is claimed is:

1. A fire extinguisher mount/locator comprising:

a housing adapted f or suspension from a wall mounted electrical outlet by an electrical plug disposed in a rear face of said housing, said housing having a substantially open front face and having retention means for retaining at least an upper portion of a fire extinguisher in an integral region thereof; and an illuminated beacon/nightlight disposed in said housing and electrically connected to said plug; and wherein said retention means comprises a bracket affixed to an interior back surface of said housing, said bracket adapted to receive and constrain a neck portion of a fire extinguisher; and wherein said housing comprises a rear housing and a front housing having means for joining said front housing and said rear housing, said means for joining comprising hinge means operatively connected to both front and rear housing in conjunction with mating notch and groove means for fixedly attaching said housings, said hinge means operatively connecting a proximal end of said housings and said notch and groove means fixedly attaching a distal end said housing.

2. A fire extinguisher mount/locator, as defined in claim 1, further comprising a rechargeable battery operatively connected between said electrical plug and said beacon/nightlight, said rechargeable battery adapted to provide continued electricity during power outages.

3. A fire extinguisher mount/locator, as defined in claim 1, further comprising an illumination sensor operatively connected between said electrical plug and said beacon/ nightlight, said illumination sensor being adapted to selectively control the illumination of said beacon/nightlight responsive to an ambient illumination level.

4. A fire extinguisher mount/locator, as defined in claim 1, further comprising at least one of the group: a motion sensor and a dimmer switch adapted for adjusting the brightness of said beacon/nightlight.

5. A fire extinguisher mount/locator, as defined in claim 4, wherein said beacon/nightlight is disposed in said front housing.

6. A fire extinguisher mount/locator, as defined in claim 5, further comprising a flashlight, a switch and a rechargeable battery, said switch adapted to selectively turn said flashlight on and off and said battery adapted to provide electrical power to said flashlight and said beacon/nightlight when said flashlight and said beacon/nightlight are unplugged from said wall mounted receptacle and during power outages.

7. A fire extinguisher mount/locator, as defined in claim 6, wherein said flashlight, said switch and said battery are disposed in said front housing.

8. A fire extinguisher mount/locator, as defined in claim 7, further comprising an electrical outlet disposed in said front housing.

9. A fire extinguisher mount/locator, as defined in claim 4, further comprising at least one electrical outlet disposed in said rear housing and operatively connected to said electrical plug.

10. A fire extinguisher mount/locator, as defined in claim 9, wherein said front housing further comprises an electrical plug and said joining means comprises said electrical plug and one of said at least one electrical outlet disposed in said rear housing.

11. A fire extinguisher mount/locator, as defined in claim 10, wherein said front housing further comprises an electrical outlet operatively connected to said electrical plug.

12. A fire extinguisher mount/locator, as defined in claim 1, further comprising a decorative skirt connected to said housing and adapted to cover a portion of a fire extinguisher mounted therein.

13. A fire extinguisher mount/locator, as defined in claim 1, wherein said mount/locator is made of one of the group: a polymer, metal and wood.

14. A fire extinguisher mount/locator comprising:

a housing adapted for suspension from a wall mounted electrical outlet comprising:

a rear housing comprising:

a substantially open housing having a top having a thickness, a back and two sides, the front and bottom being open, forming a concavity therein, an electrical plug disposed in an exterior back surface thereof, said electrical plug adapted for connection to said wall mounted electrical outlet, a bracket affixed to an interior back surface of, said rear housing, said bracket adapted to receive and constrain at least an upper portion of a fire extinguisher, at least one electrical outlet, said at least one electrical outlet operatively connected to said electrical plug, one of said at least one electrical outlet disposed in the front edge of said thickness of said top; and a front housing comprising:

a substantially open housing having a top having a thickness, a bottom and two sides, the back and the bottom being open, forming a concavity therein, an electrical plug disposed proximate the rear edge of said thickness of said top, an electrical outlet operatively connected to said electrical plug, a beacon/nightlight light operatively connected to said plug, and a flashlight operatively connected to said plug through a switch, said beacon/nightlight and said flashlight operatively connected to said plug through a rechargeable battery;

said electrical plug disposed in said front housing adapted to engage said one of said at least one electrical outlet disposed in said rear housing.

15. A fire extinguisher mount/locator, as defined in claim 14, further comprising a decorative skirt adapted to cover a portion of the fire extinguisher stored therein.

16. A fire extinguisher mount/locator, as defined in claim 14, further comprising a flexible electrical cord intermediate and operatively connected to said electrical plug disposed in said exterior back surface of said rear housing and said rear housing.

* * * * *